US007334542B2

(12) United States Patent
Zorzit et al.

(10) Patent No.: US 7,334,542 B2
(45) Date of Patent: Feb. 26, 2008

(54) COMPACT HIGH-EFFICIENCY BOILER AND METHOD FOR PRODUCING STEAM

(75) Inventors: Vittorio Zorzit, Ontario (CA); Lawrence Farrelly, Niskayuna, NY (US)

(73) Assignee: UNILUX Advanced Manufacturing, Inc., Niskayuna, NY (US)

( * ) Notice: Subject to any disclaimer, the term of this patent is extended or adjusted under 35 U.S.C. 154(b) by 49 days.

(21) Appl. No.: 11/494,046

(22) Filed: Jul. 27, 2006

(65) Prior Publication Data

US 2008/0022947 A1 Jan. 31, 2008

(51) Int. Cl.
*F22B 15/00* (2006.01)

(52) U.S. Cl. ..... 122/235.19; 122/235.15; 122/235.32; 122/235.11

(58) Field of Classification Search ..... 122/235.19, 122/235.21, 235.29, 235.34, 235.35, 235.15, 122/235.31, 235.32, 235.11
See application file for complete search history.

(56) References Cited

U.S. PATENT DOCUMENTS

| | | | | |
|---|---|---|---|---|
| 477,880 A | | 6/1892 | Wojan | |
| 2,186,919 A | * | 1/1940 | Bailey | 122/336 |
| 2,648,316 A | | 8/1953 | Marshall | 122/331 |
| 3,386,420 A | * | 6/1968 | Cleaver et al. | 122/235.11 |
| 3,476,090 A | * | 11/1969 | Sheikh | 122/478 |
| 4,355,602 A | | 10/1982 | Cooke | 122/235 R |
| 4,612,879 A | | 9/1986 | Cooke | 122/235 F |
| 5,050,542 A | | 9/1991 | Cooke | 122/235.23 |
| 5,353,749 A | * | 10/1994 | Seibel et al. | 122/240.1 |
| 5,870,976 A | | 2/1999 | Cooke | 122/347 |
| 5,881,551 A | | 3/1999 | Dang | 60/39.182 |
| 6,901,887 B2 | | 6/2005 | English | 122/331 |
| 7,137,360 B1 | * | 11/2006 | Zorzit | 122/235.11 |

* cited by examiner

*Primary Examiner*—Gregory Wilson
(74) *Attorney, Agent, or Firm*—Heslin Rothenberg Farley & Mesiti P.C.; John Pietrangelo

(57) ABSTRACT

A boiler that enhances the efficiency of the use of heated gas streams to generate steam is provided. The boiler includes a lower drum, an upper drum, a plurality of conduits adapted to transfer heated fluid from the lower drum to the upper drum, a combustion chamber, and a series of heat transfer chambers adapted to receive combustion gases from the combustion chamber. The first of the heat transfer chambers is positioned above the second heat transfer chamber and receives the heated gas from the combustion chamber prior to the second heat transfer chamber. A method of operating the boiler is also provided. Though aspects of the invention are applicable to package boilers, other aspects of the invention are applicable for use in residential, commercial, or industrial settings.

20 Claims, 10 Drawing Sheets

COMPACT HIGH-EFFICIENCY BOILER AND METHOD FOR PRODUCING STEAM

TECHNICAL FIELD

The present invention relates boilers, and methods for operating boilers whereby a more efficient transfer of energy from combustion gases to the working fluid is obtained. Specifically, a novel boiler and method for operating a boiler is provided whereby the combustion gases are passed through a series of chambers in a vertically downward direction.

BACKGROUND OF THE INVENTION

Boilers are classified into two distinct types commonly known as fire tube and water tube boilers. A fire tube boiler transfers heat to the water by moving hot gases along the inside of small tubes in a controlled path. The water is in a large mass and, except for natural convection forces, the water is stationary. A water tube boiler transfers heat by confining the water in small tubes which causes the water to flow rapidly upwards, creating controlled rapid water circulation. The hot gases are not controlled to any absolute specific path. Fire tube boilers are the more economical type up to 20,000 pounds of steam per hour capacity whereas water tube boilers are the more economical for capacities over 20,000 pounds of steam per hour.

Both boiler types are designed to run at a fuel to water efficiency of 80 percent. To obtain higher efficiencies both types of boilers must go to expensive additional equipment and these decisions are usually made on a job-by-job basis, depending on the particular application.

Numerous designs exist but it is an object of the present invention to provide one which is simple to construct, assemble and operate, which is highly efficient and capable of handling varying loads, and which is suitable for use on large scale as in large buildings, industrial electric and co-generation plants as well as in relatively small residential installations.

These objects are realized in accordance with the present invention pursuant to which there is provided a boiler comprising a housing having a top provided with a gas outlet, bottom, left and right sides and a front and back, and within the housing an upper manifold and lower manifold or manifolds substantially parallel to the top, bottom and side walls, two sets of tubes, each set comprising a plurality of tubes, one set joining the upper left side of the manifold to the lower left side of the manifold and the other set joining the upper right side of the manifold to the lower right of the manifold, the tubes of each set rising from their lower manifold upwardly along their respective side wall, crossing the housing to the opposite side wall, re-crossing the housing to their respective side wall, rising there along and eventually joining their upper manifold, the horizontal runs of the tubes of one set being vertically offset relative to the horizontal runs of the tubes of the other set so as to form a plurality of superposed chambers, at least one tube of each set being differently bent from the others of that set so as to form access openings from each chamber to the chambers above and below, the openings from chamber to chamber being offset so as to require a gas flowing through said chambers to traverse one chamber from front to back and the next chamber from back to front, means for introducing liquid into one of the manifolds and for withdrawing the liquid from the outer manifold, and means for introducing a combustion gas into the lowermost of the superposed chambers, the combustion gas rising successively through the chambers which is successively and alternately traverses from front to back and then from back to front until it exits from the uppermost chamber through the gas outlet in the top, liquid flowing through the manifolds and tubes being heated by the combustion gas.

Advantageously, the tubes of each set are in substantial contact with one another so as substantially to prevent passage of combustion gas there between. In a preferred embodiment there is provided at least one baffle within at least one of the chambers extending from top to bottom and from one of the sides toward but terminating short of the other side, whereby combustion gas traversing that chamber from front to back is additionally forced to flow laterally to get around said baffle.

The boiler meets all of the requirements of the American Society of Mechanical Engineers boiler and pressure vessels, sections I and IV, which are recognized by agencies of most governments. The novel boiler incorporates the best features of the fire tube boiler by controlling the passage of hot gases and, by confining the water within small tubes, takes advantage of the best features of the water tube boiler.

All internal parts and surfaces are easily accessible for service and cleaning so the unit is suitable for burning light oil, residual oils, crude oils, waste oils, any type of gas, any type of coal or solid fuel including municipal waste.

SUMMARY OF THE INVENTION

Aspects of the present invention overcome the disadvantages of the existing art of boiler fabrication and operation. One aspect is a boiler including a lower drum adapted to receive water; an upper drum having a heated fluid outlet; a plurality of conduits adapted to transfer fluid from the lower drum to the upper drum; at least one downcomer adapted to transfer fluid from the upper drum to the lower drum; a combustion chamber having an inlet adapted to receive heat from a source of combustion and an outlet adapted to discharge a heated gas, wherein walls of the combustion chamber comprise at least some of the plurality of conduits; a first heat transfer chamber having an inlet adapted to receive the heated gas from the combustion chamber and an outlet, wherein walls of the first heat transfer chamber comprise at least some of the plurality of conduits; and a second heat transfer chamber positioned below the first heat transfer chamber, the second heat transfer chamber having an inlet adapted to receive the heated gas from the outlet of the first heat transfer chamber and a outlet, wherein walls of the second heat transfer chamber comprise at least some of the plurality of conduits; wherein the first heat transfer chamber positioned above the second heat transfer chamber receives the heated gas from the combustion chamber prior to the second heat transfer chamber and wherein heated fluid is discharged from the heated fluid outlet of the upper drum. In one aspect, the at least some of the plurality of conduits that comprise the walls of the combustion chamber, first heat transfer chamber, and second heat transfer chamber are substantially in contact with each other wherein passage of gas between the conduits is substantially prevented.

Another aspect of the invention is a method for producing steam in a boiler including a lower drum adapted to receive a fluid; an upper drum having a heated fluid outlet; a plurality of conduits adapted to transfer fluid from the lower drum to the upper drum; a combustion chamber having walls comprising at least some of the plurality of conduits; a first heat transfer chamber having walls comprising at least some of the plurality of conduits; and a second heat transfer chamber positioned below the first heat transfer chamber, the second heat transfer chamber having walls comprising at least some of the plurality of conduits; the method including: introducing a heated gas stream to the combustion chamber and heating the fluid in the conduits that comprise the walls of the combustion chamber; passing the heated gas stream from the combustion chamber to the first heat transfer chamber and heating the fluid in the conduits that comprise the walls of the first heat transfer chamber; passing the heated gas stream from the first heat transfer chamber to the second heat transfer chamber, below the first heat transfer chamber, and heating the fluid in the conduits that comprise the walls of the second heat transfer chamber; discharging the heated gas from the second heat transfer chamber; and generating heated fluid in at least some of the plurality of conduits that comprise the walls of at least one of the combustion chamber, the first heat transfer chamber, and the second heat transfer chamber. In one aspect, passing the heated gas stream from the first heat transfer chamber to the second heat transfer chamber is practiced in a downward direction.

These and other aspects, features, and advantages of this invention will become apparent from the following detailed description of the various aspects of the invention taken in conjunction with the accompanying drawings

BRIEF DESCRIPTION OF THE DRAWINGS

The subject matter, which is regarded as the invention, is particularly pointed out and distinctly claimed in the claims at the conclusion of the specification. The foregoing and other objects, features, and advantages of the invention will be readily understood from the following detailed description of aspects of the invention taken in conjunction with the accompanying drawings in which:

DETAILED DESCRIPTION OF THE INVENTION

Figure 1:
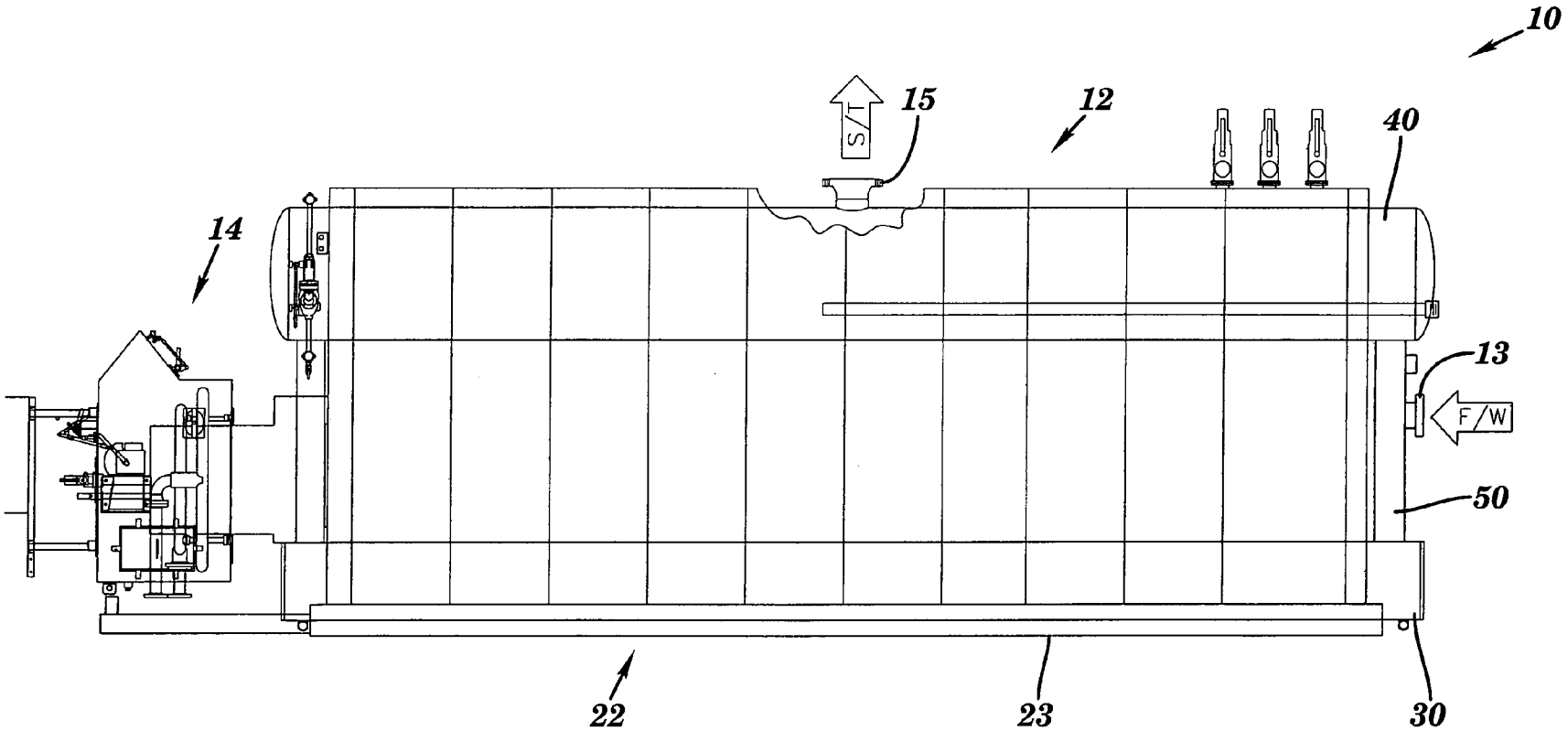
FIG. 1 is a side elevational view of a boiler assembly according to one aspect of the invention.
Figure 2:
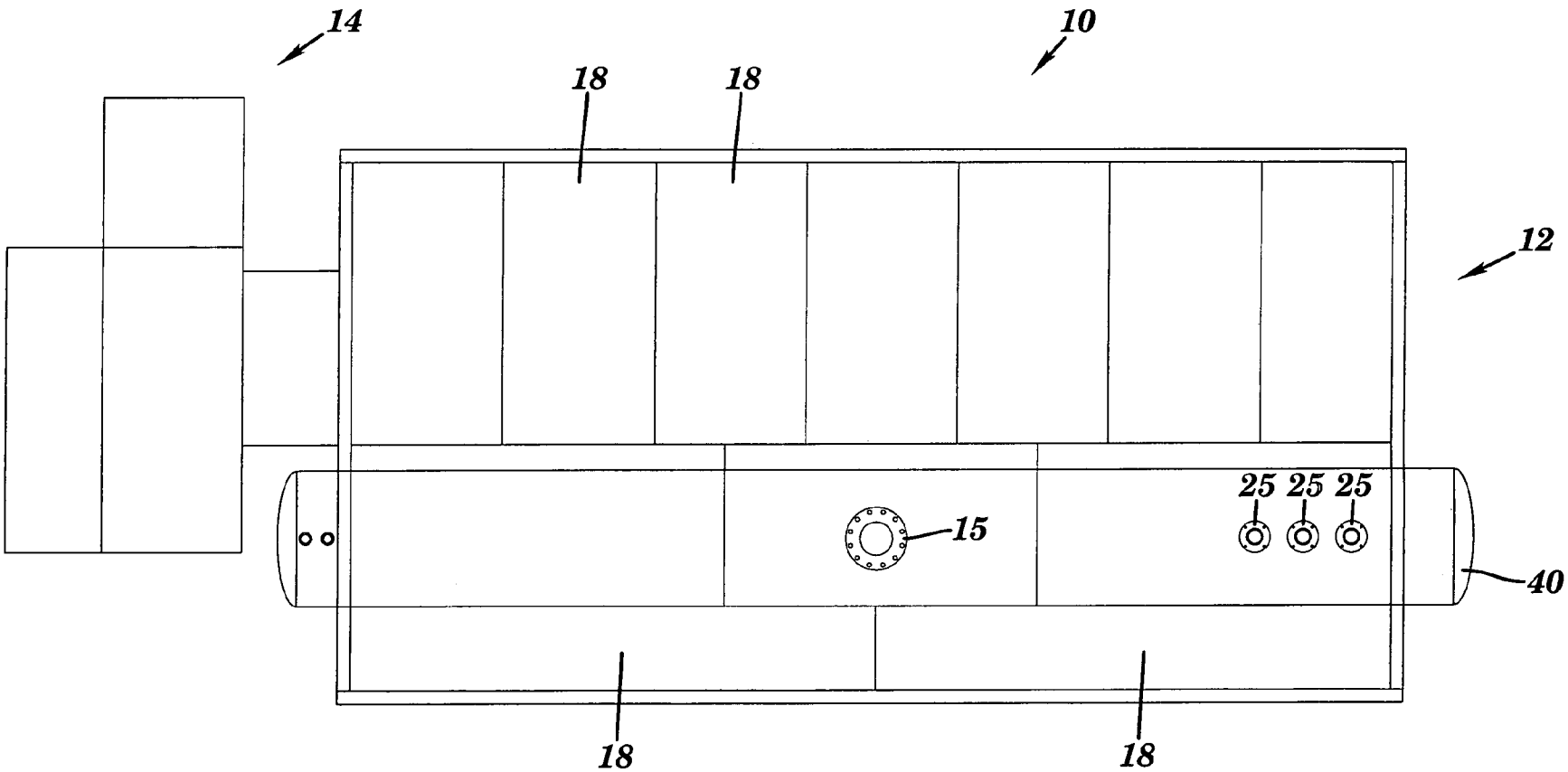
FIG. 2 is a top plan view of the boiler assembly shown in FIG. 1.
Figure 3:
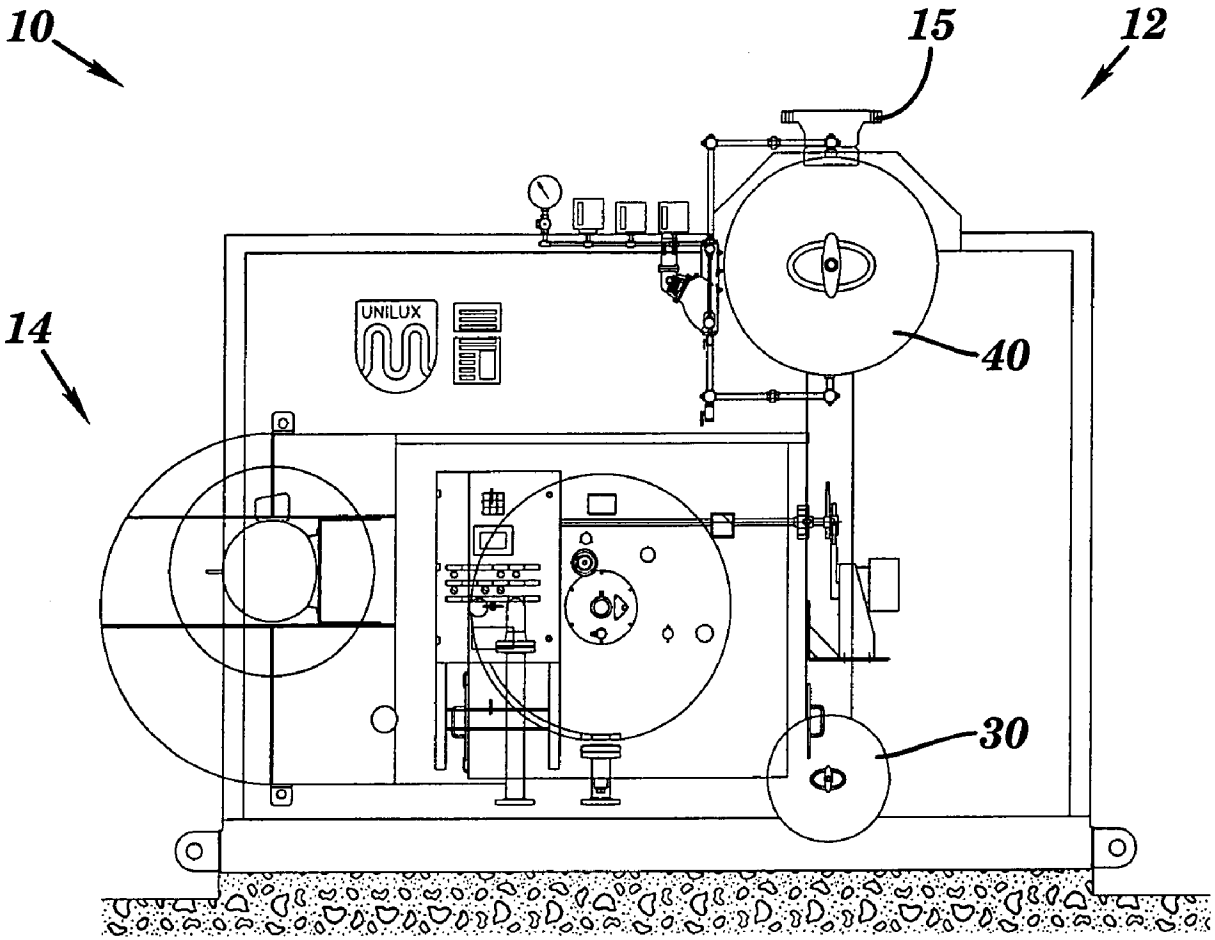
FIG. 3 is a front elevational view of the boiler assembly shown in FIG. 1.
Figure 4:
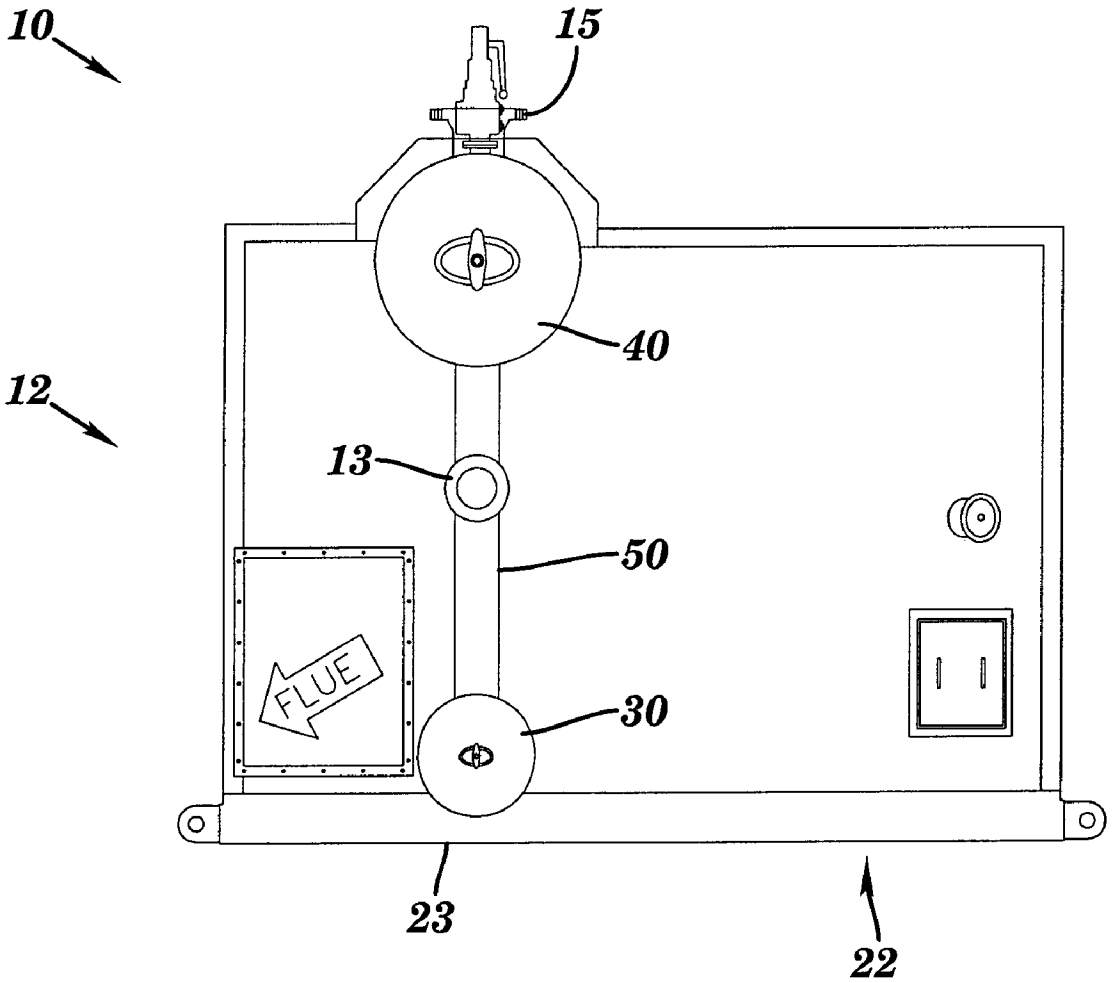
FIG. 4 is a rear elevational view of the boiler assembly shown in FIG. 1.
Figure 5:
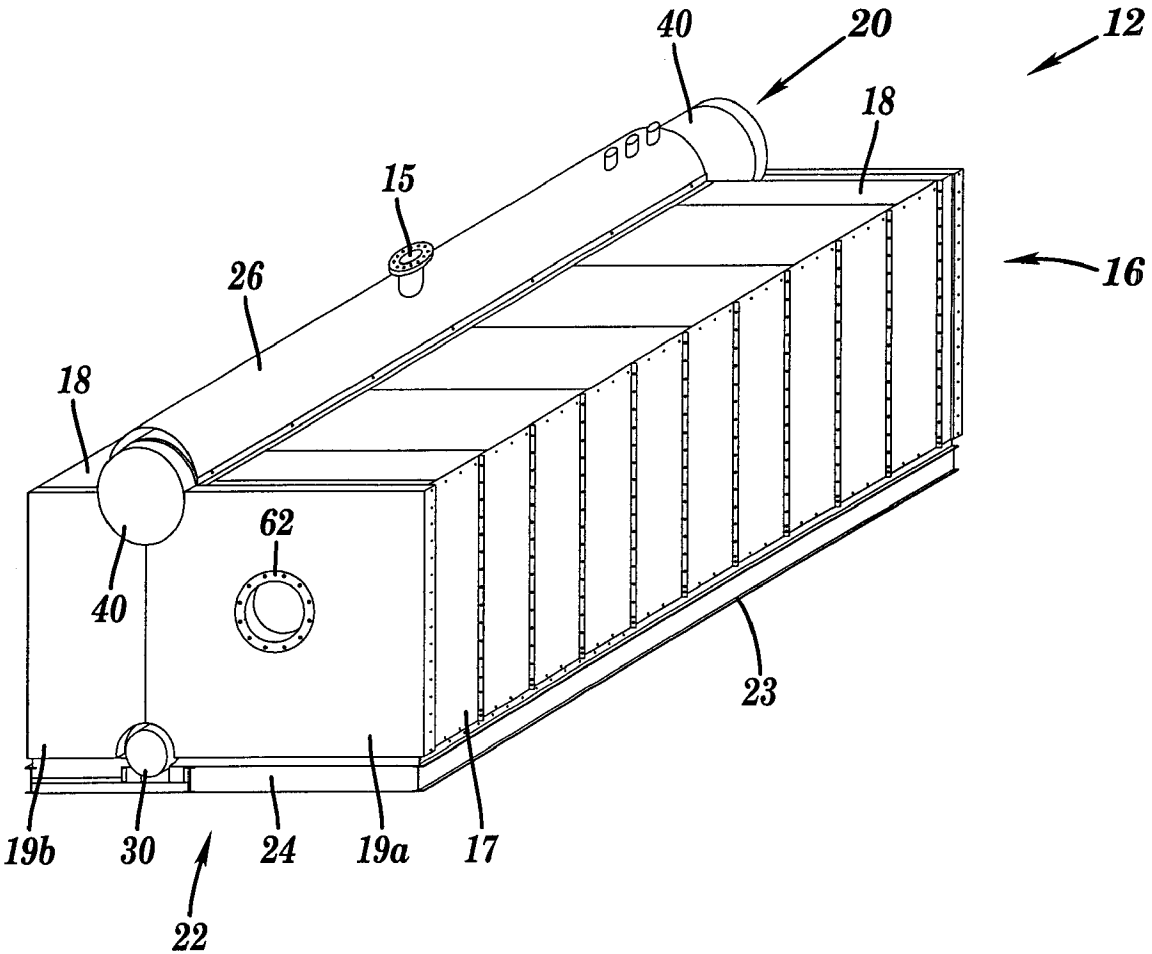
FIG. 5 is a perspective view of a boiler assembly shown in FIGS. 1-4 with ancillary equipment removed.
Figure 6:
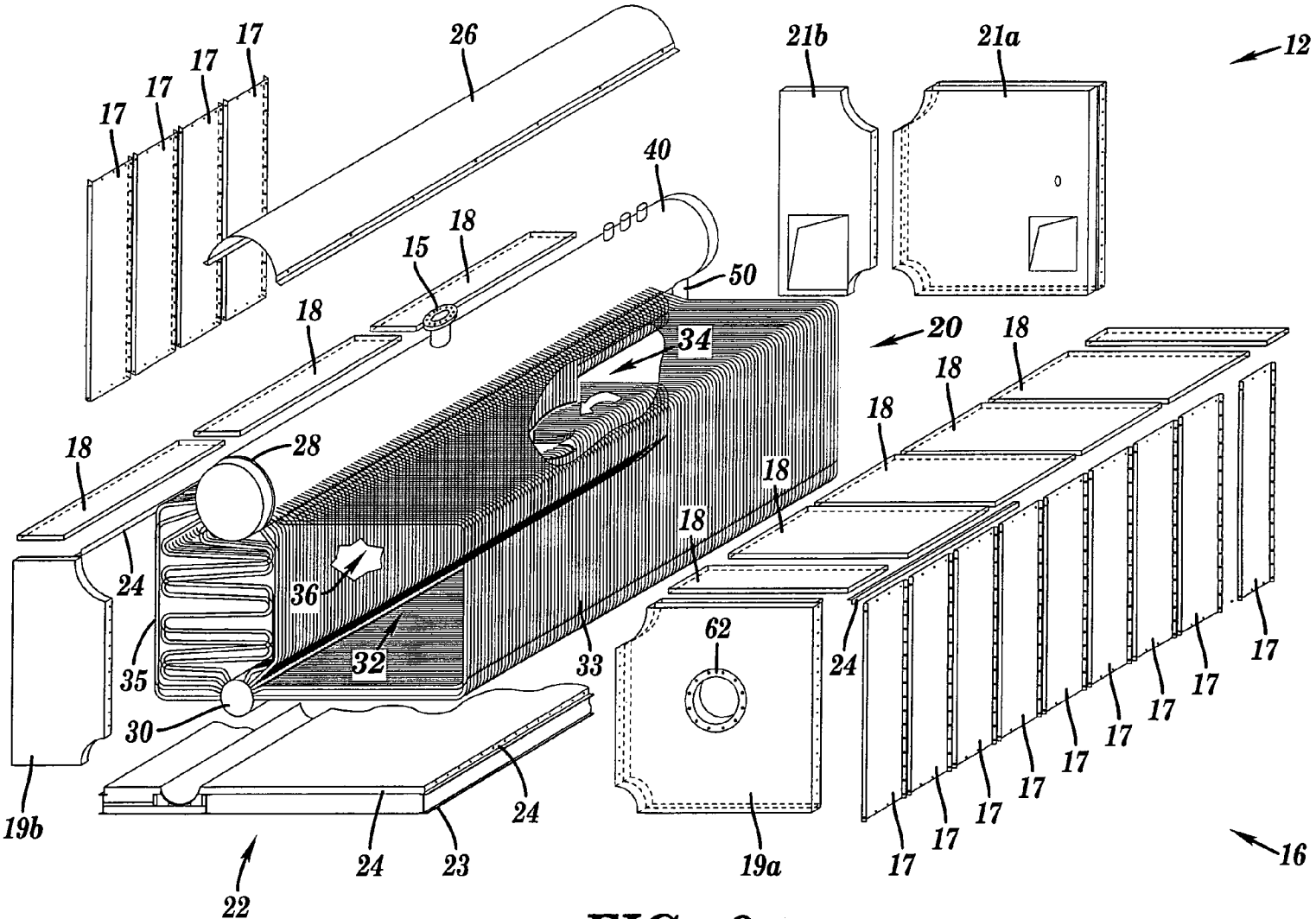
FIG. 6 is an exploded perspective view of the boiler assembly shown in FIG. 5.

Aspects of the present invention provide a boiler, a boiler system, and a method of operating a boiler that enhances the efficiency of the use of the heated gas stream while providing a convenient "package" boiler for use in residential, commercial, and industrial environments. FIG. 1 is a side elevational view of a boiler installation 10 according to one aspect of the invention. FIG. 2 is a top plan view of boiler installation 10 shown in FIG. 1, FIG. 3 is a front elevational view of boiler installation 10 shown in FIG. 1, and FIG. 4 is a rear elevational view of boiler installation 10 shown in FIG. 1. As shown in FIGS. 1-4, boiler installation 10 includes a boiler assembly 12 and a suite of ancillary equipment 14, for example, fuel supply conduits, fuel burners, pumps, valves, controls, and related equipment for operating boiler installation 10. Boiler assembly 12 includes a feed fluid inlet 13, for example, for water, and a heated fluid outlet 15, for example, for steam. FIG. 5 is a perspective view of boiler assembly 12 shown in FIGS. 1-4 with ancillary equipment 14 removed for clarity. FIG. 6 is an exploded perspective view of the boiler assembly 12 shown in FIG. 5.

As shown most clearly in FIGS. 5 and 6, boiler assembly 12 includes a housing 16 and a boiler 20 contained in housing 16. Housing 16 includes a series of removablely mounted panels and/or replaceable panels that surround boiler 20, including side panels 17, roof panels 18, front end panels 19*a* and 19*b*, and rear end panels 21*a* and 21*b*. As shown in FIG. 6, end front panels 19*a* and 19*b* and rear end panels 21*a* and 21*b* may be adapted to accommodate boiler 20, for example, front panels 19*a* and 19*b* and rear end panels 21*a* and 21*b* include cutouts shape to adapt to the drums of boiler 20 and access openings for allowing conduit access to boiler 20.

As shown in FIG. 6, housing 16 also includes a base 22 that provides a foundation for boiler assembly 12. Base 22, which only a representative section of is shown in FIG. 6, may be a reinforced poured material, for example, a poured refractory material. Base 22 may comprise a steel support structure 23 adapted to receive the poured material. The support structure 23 may include appropriate structural members and stiffeners to ensure a proper foundation for the boiler. The poured material may comprise a high-temperature refractory material that can be poured as a slurry and then cured.

According to aspects of the invention, panels 17, 18, 19*a*, 19*b*, 21*a*, and 21*b* may provide a gas-tight housing allowing little or no thermal losses due to escape of heat. Panels 17, 18, 19*a*, 19*b*, 21*a*, and 21*b* may typically be made from sheet metal, for example, steel or aluminum, with reinforcing or stiffening members as appropriate. The panels may typically include some form of thermally insulating material, for example, one or more layers of high-temperature fiber insulation, such as a blanket-type insulation. According to one aspect of the invention, removable panels 17, 18, 19*a*, 19*b*, 21*a*, and 21*b* may be removably mounted by means of mechanical fasteners (not shown), for example, threaded fasteners, to horizontal or vertical mounting angles 24. The mating surfaces of the panels may also be gasketed to minimize gas and thermal leakage, for example, a woven gasket material may be mounted between mating panel surfaces. As shown in FIG. 6, mounting angles 24 may also be mounted support structure 23 of base 22.

According to aspects of the invention, removable panels 17, 18, 19*a*, 19*b*, 21*a*, and 21*b* permit relatively easy access to boiler 20 for maintenance and service. One or more panels may be removed in an area of concern, even without interrupting the operation of boiler 20, and those areas serviced as needed. Unlike other conventional boiler assemblies, no torch cutting or weld grinding is necessary to service and maintain boiler 20 according to aspects of the invention.

As will be discussed more completely below, boiler 20 may include one or more upper drums 40. Drum 40 may also include a sheet metal cover 26 shaped to conform to drum 40. A layer of insulation 28 may also be provided beneath cover 26 to insulate drum 40.

As shown in FIG. 6, according to aspects of the invention boiler 20 includes a lower drum, or feed water drum, 30 and an upper drum, or steam drum, 40, and a plurality of conduits or pipes that pass from the lower drum 30 to upper drum 40. As is typical, drums 30 and 40 comprise circular cylindrical cavities having covers or heads at either end. As is typical of boiler operation, the plurality of conduits that pass from lower drum 30 to upper drum 40 are positioned to maximize the transfer of heat from a heated gas passing across the conduits into the fluid passing though the conduits. As is also typical in the art, the plurality of conduits that connect lower drum 30 to upper drum 40 are shaped to permit access to the plurality of conduits to the respective drums while minimizing interference between conduits. As is known in the conventional art, the heating of the cooler liquid introduced to the lower drum 30 by the heated gas causes the heated fluid to rise by natural convention to the upper drum 40. As is also known in the conventional art, one or more return conduits 50, or "down comers", between upper drum 40 and lower drum 30 are provided to provide a path for fluid to return from the upper drum 40 to the lower drum 30 to complete the fluid circuit that is driven by the convention caused by heating the fluid. This natural circulation is typical of boiler art and requires no external pumps or other pressurization devices. However, according to aspects of the present invention, the path of the heated gas that flows through boiler 20 improves, among other things, the efficiency of boiler 20.

Boiler 20 includes a plurality of heated gas flow passages adapted to extract as much energy as possible from the source of heated gas and transfer this energy to the working fluid supplied to drums 30 and 40, for example, typically water or a mixture of water and glycol. As shown in FIG. 6, boiler 20 includes at least one first heated gas passage 32, and a plurality of second passages 34 and 36. According to aspects of the invention, heated gas passage 32 is bounded by a plurality of conduits 33 which provide fluid passage ways from lower drum 30 to upper drum 40. The plurality of conduits 33 may be ferrule-mounted or welded to the lower drum 30 or the upper drum 40, depending upon operating pressure. The plurality of conduits 33 may typically be substantially in contact with each other wherein the passage of gas between conduits 33 is substantially prevented. Passage 32 is exposed to a source of heat, typically a flame, produced by a burner, for example, a fossil fuel burner (not shown) provided with ancillary equipment 14 and introduced through hole 62 in panel 19*a*. A typical flame 60 is shown in the plan view of FIG. 8 below. Passage 32 is typically referred to as the "radiant heating" zone of boiler 32 since the conduits 33 bounding passage 32 are typically directly exposed to radiant heat of the flame generated by the burner. As shown in FIG. 6, the conduits 33 that define the boundaries or walls of passage 32 are positioned to maximize the transfer of heat from the flame to the fluid in conduits 33 while minimizing or preventing the overexposure of conduits 33 to direct flame. Accordingly, conduits 33 are shaped whereby passage 32 is square or rectangular in cross section (though passage 32 may be circular or oval) wherein passage 32 comprises, as what is typically referred to in the art, a "D-shaped" passage 32.

The heated gas generated by flame 60 in radiant heating passage 32 is passed to two or more heating passages 34, 36, typically referred to as "convective heating" passages. Heating passages 34 and 36 may typical comprise horizontal passages. Similar to passage 32, passages 34 and 36 are also bounded by a plurality of conduits 35 which provide fluid communication between the lower drum 30 and the upper drum 40. The plurality of conduits 35 may be ferrule-mounted or welded to the lower drum 30 or the upper drum 40, depending upon operating pressure. As is typical in the art, passages 34 and 36 may be bounded by a plurality of common conduits 35 passing from lower drum 30 to upper drum 40 containing a working fluid, such as water. The plurality of conduits 35 may be substantially in contact with each other wherein passage of gas between conduits 35 is substantially prevented. However, according to aspects of the invention, the heated gas generated in passage 32 is passed first to upper passage 34, which is positioned above a lower passage 36, and then to lower passage 36. The heated gas discharged from the outlet of the combustion chamber 32 may comprise a first temperature and the heated gas discharged from the outlet of first heat transfer chamber 34 may comprises a second temperature, lower than the first temperature. That is, according to aspects of the invention, the heated gas generated in radiant heating passage 32 is first passed across or by conduits 35 bounding passage 34, the conduits 35 bounding passage 34 having a fluid having a first, higher temperature, and then passing the heated gas from passage 34 to passage 36, for example, in a downward direction, the conduits 35 having a second, lower temperature, for example, lower than the first temperature of the fluid in conduits 35 bounding passage 34. That is, the fluid in conduits 35 comprising the walls of first heat transfer chamber 34 may comprise a temperature greater than the temperature of the fluid in the walls of second heat transfer chamber 36. In one aspect, the fluid in conduits 35 comprising the walls of first heat transfer chamber 34 may comprise a temperature greater than the temperature of the fluid in the walls of second heat transfer chamber 36. After passing through passage 36, the heated gas may be discharged from boiler 20, for example, out of flue 50 and to a stack (not shown), or may be passed through one or more further passages similar to passages 34 and 36 before being discharged from boiler 20.

According to aspects of the invention, the passing of the heated gases past the cooler fluid in passage 36 prior to discharge from boiler 20 may reduce the temperature of gases discharged from the boiler and thus, provide greater boiler efficiency. For example, efficiencies of at least 80% may be provided. Efficiencies of 85% or greater can be provided, or even efficiencies of 90% or greater may be provided. In another aspect, the heated gas may be passed through a heat exchanger for heating the feed water introduced to lower drum 30, for example, a heat exchanger typically referred to in the art as an "economizer."

In one aspect of the invention, the convective heating passages 34 and 36 may be provided by a plurality of conduits 35 whereby the assembly permits as least some flexibility to the boiler assembly. In one aspect, this flexibility permits aspects of the invention to absorb at least some thermal "shock," that is, aspects of the invention are capable of withstanding temperature variations which can cause variations in thermal expansion without causing failure to, for example, conduits 33 and 35, drums 30 and 40, or the connections there between. Accordingly, aspects of the invention are marketed under the trademark D-FLEX by Unilux Advanced Manufacturing of Niskayuna, N.Y.

Figure 7:
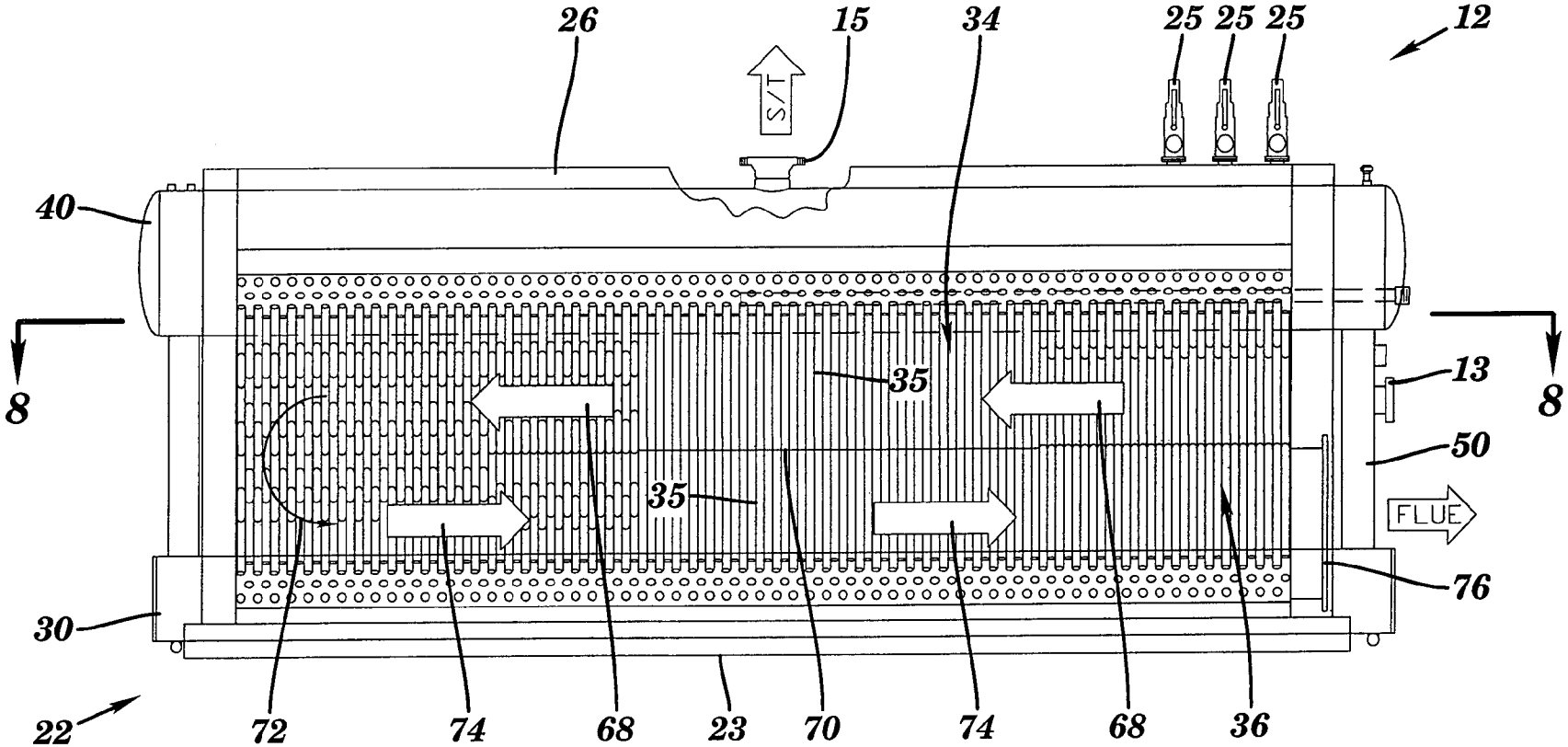
FIG. 7 is left-side elevation view of the boiler assembly shown in FIG. 5, with the left-side housing panels removed.
Figure 8:
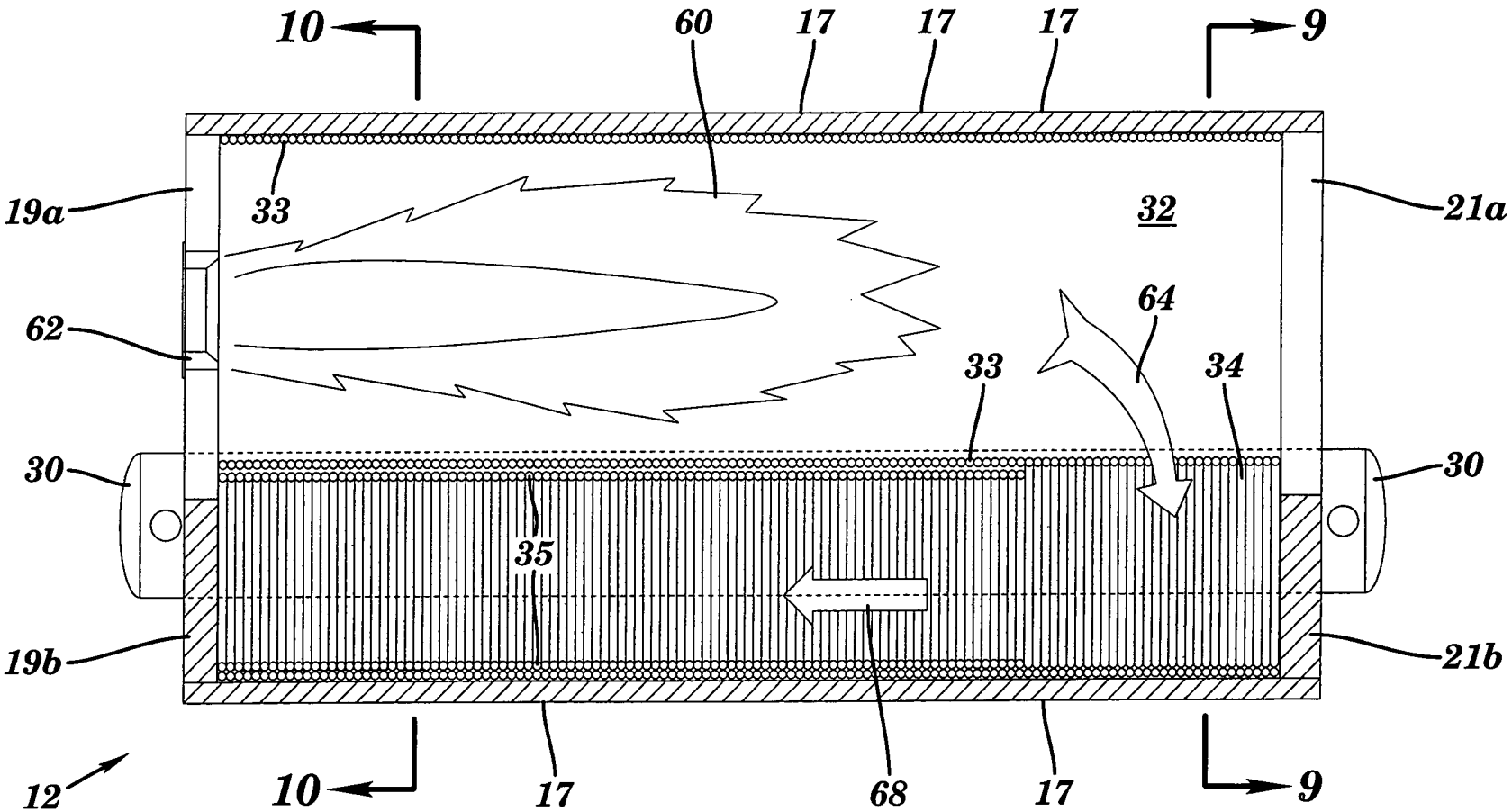
FIG. 8 is a top cross-sectional view of the boiler assembly shown in FIG. 7 as viewed along section lines 8-8 in FIG. 7.
Figure 9:
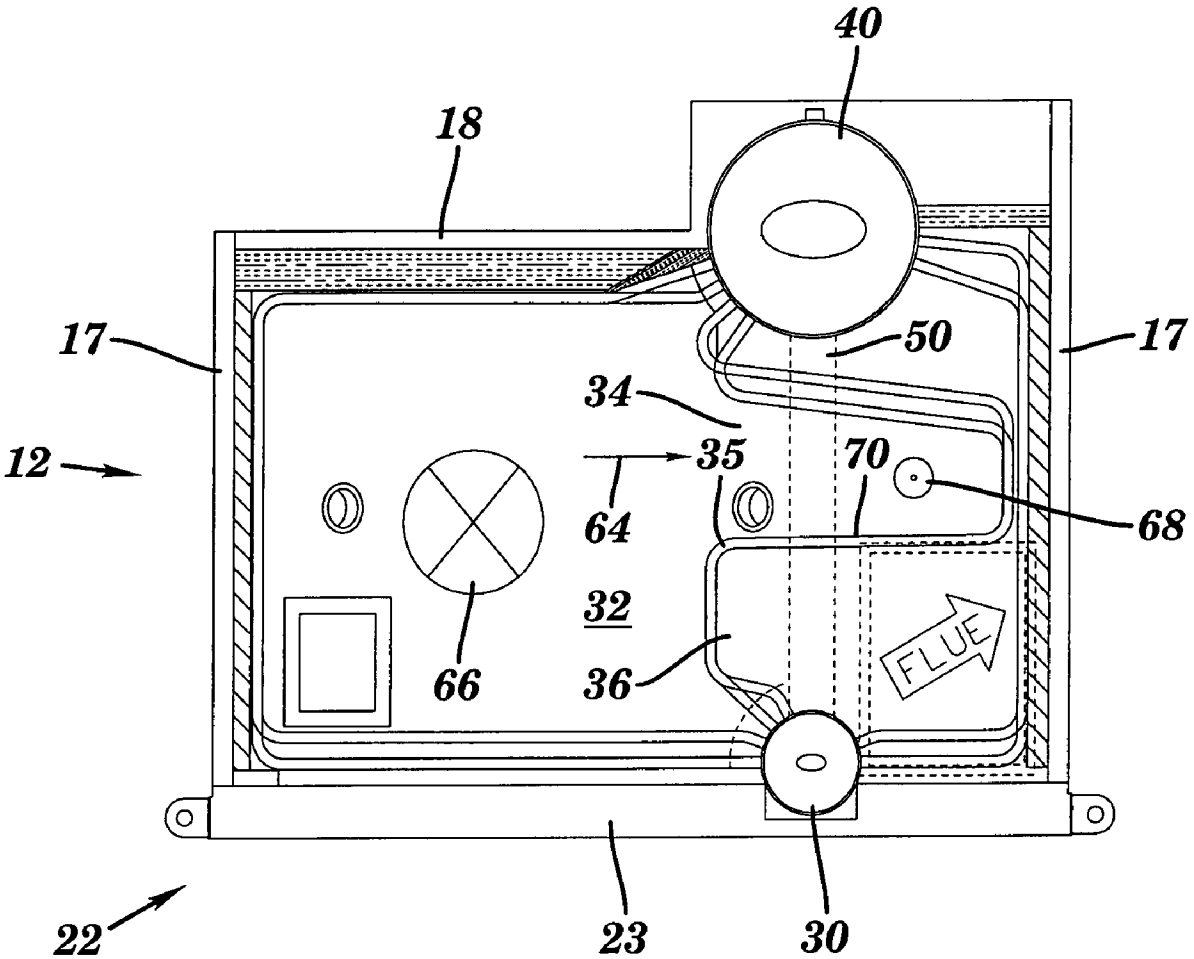
FIG. 9 is a cross sectional view of the boiler assembly shown in FIG. 8 as viewed along section lines 9-9 in FIG. 8.
Figure 10:
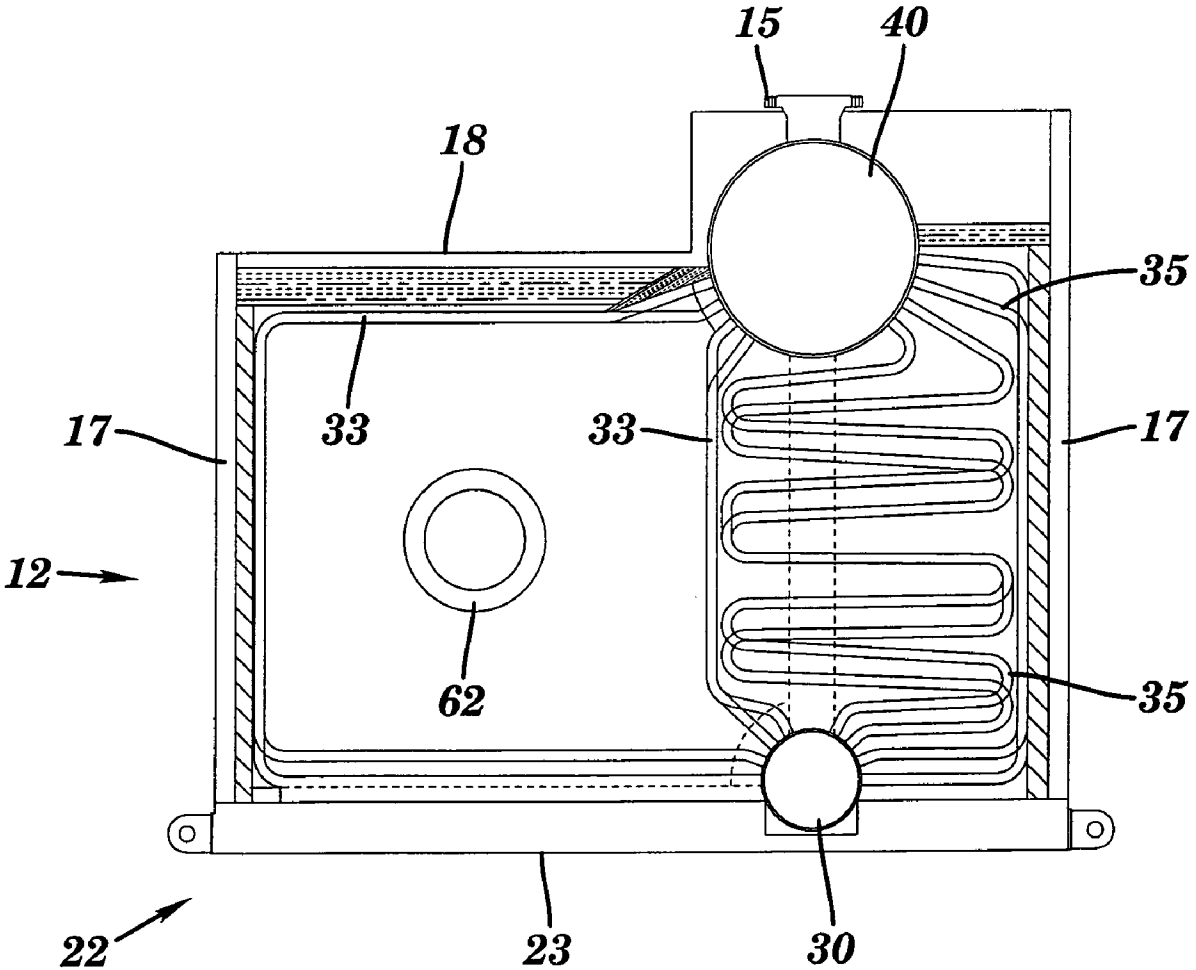
FIG. 10 is a cross sectional view of the boiler assembly shown in FIG. 8 as viewed along section lines 10-10 in FIG. 8.

Further details of boiler 20 are illustrated in FIGS. 7 through 10. FIG. 7 is left-side elevation view of the boiler assembly 12 shown in FIG. 5, with the left-side housing panels 17 removed. FIG. 8 is a top cross-sectional view of the boiler assembly 12 shown in FIG. 7 as viewed along section lines 8-8 in FIG. 7. FIG. 9 is a cross sectional view of boiler assembly 12 shown in FIG. 8 as viewed along section lines 9-9 in FIG. 8. FIG. 10 is a cross sectional view of boiler assembly 12 shown in FIG. 8 as viewed along section lines 10-10 in FIG. 8.

As shown in FIG. 8, the flame 60 produced by ancillary equipment 14, for example, produced by the ignition of oil, natural gas, propone, digester gas, and kerosene, among other combustible materials, is provided in passage 32. The flame may be provided by a burner (not shown) having a flame outlet directed through a hole 62 in front panel 19*a*. As shown in FIG. 8, front panels 19*a* and 19*b* and end panels 21*a* and 21*b* typically include some form of heat resistant material due to their exposure directly to flame 60. The flame resistant material may be a refractory material, for example, a high temperature refractory material capable of withstanding a temperature of 2800 degrees F.

As flame 60 passes through passage 32, the fluid in conduits 33 that bound passage 32 is heated thereby causing the fluid in conduits 33 to rise and pass from lower drum 30 to upper drum 40. At the distal end of passage 32, the heated gas generated by flame 60, that is, the heated air and the products of combustion produced by flame 60, for example, carbon dioxide ($CO_2$), carbon monoxide (CO), and water vapor ($H_2O$), among other gases, pass from chamber 32 into chamber 34, as indicated by arrow 64 shown in FIG. 8. This passage of heated gases from chamber 32 to chamber 34 is more clearly illustrated in FIG. 9, where the arrow tail 66 represents the direction of flow of the heated gasses through chamber 32, arrow 64 represents the direction of flow of heated gasses from chamber 32 to chamber 34, and arrow head 68 represents the flow of gases in chamber 34, for example, opposite the direction of the flow of gases through chamber 32 (as indicted by arrow tail 66).

As shown in FIG. 9, the boundaries of chamber 34 may be provided by conduits 35 shaped to communicate between lower drum 30 and upper drum 40. For example, as shown in FIGS. 7 and 9, the horizontal section 70 of conduits 35 define the lower boundary of chamber 34 and the upper boundary of chamber 36. As shown most clearly in FIG. 7, when the flow of heated gases in chamber 34, as indicated by arrows 68, reaches the near end of boiler 20, the heated gases are allowed to flow from chamber 34 to lower chamber 36, as indicated by arrow 72, and then flow through chamber 36, as indicated by arrows 74, to gas discharge outlet or flue 76. As shown in FIG. 10, in the section of boiler 20 where the heated gases pass from passage 34 to passage 36 (as indicated by arrow 72 in FIG. 7), the shape of conduits 35 may be so adapted to enhance the exposure of conduits 35 to heated gases, for example, in the multiple traversals of passages 34 and 36 by conduits 35 in the heated gas stream as shown in FIG. 10. As shown in FIG. 7, boiler 20 may also include one or more safety relief valves, 25.

Again, according to aspects of the invention, the heated gas stream generated by flame 60 in chamber 32 is first passed through an upper passage 34 lined by a plurality of conduits 35 and then passed through a second, lower passage 36, below passage 34, before passing the heated gas stream to one or more further passages 34 and 36 or to flue 76. According to aspects of the invention, this flow of heated gases from the radiant heating chamber 32 to conductive heating chambers 34 and 36 provides a more efficient boiler operation where, for example, the hottest combustion gases are used to heat the hottest working fluid and the cooler combustion gases are used to heat the cooler working fluid. As a result, according to aspects of the invention, the combustion gases discharged from boiler 20, for example, discharged from the flue, are typically lower in temperature than conventional boilers. The lower temperature discharge gases of the present invention can reduced NOx and reduced SOx emissions compared to conventional boiler designs.

Though aspects of the invention may be applied to all types of boilers, including residential, commercial, and industrial boilers, aspects of the invention may be particularly applicable to the field of "package" boilers. That is, boiler assemblies that can be fabricated off-site and shipped as one component or several components for installation on site. Boilers according to aspects of the present invention may be rated for energy inputs ranging from between about 10,000 thousand BTUs per hour (MBH) to about 100,000 MBH, for example, between about 50,000 MBH to about 75,000 MBH and steam outputs ranging from about 20,000 pounds per hour (PPH) to about 100,000 PPH, for example, between about 40,000 PPH to about 60,000 PPH. A boiler according to aspects of the present invention may be used for schools and universities, military bases, power plant, large commercial facilities and for individual residences.

While several aspects of the present invention have been described and depicted herein, alternative aspects may be effected by those skilled in the art to accomplish the same objectives. Accordingly, it is intended by the appended claims to cover all such alternative aspects as fall within the true spirit and scope of the invention.

The invention claimed is:

1. A boiler comprising:

a lower drum adapted to receive water;

an upper drum having a heated fluid outlet;

a plurality of conduits adapted to transfer fluid from the lower drum to the upper drum;

at least one downcomer adapted to transfer fluid from the upper drum to the lower drum;

a combustion chamber having an inlet adapted to receive heat from a source of combustion and an outlet adapted to discharge a heated gas, wherein walls of the combustion chamber comprise at least some of the plurality of conduits;

a first heat transfer chamber having an inlet adapted to receive the heated gas from the combustion chamber and an outlet, wherein walls of the first heat transfer chamber comprise at least some of the plurality of conduits; and a second heat transfer chamber positioned below the first heat transfer chamber, the second heat transfer chamber having an inlet adapted to receive the heated gas from the outlet of the first heat transfer chamber and a outlet, wherein walls of the second heat transfer chamber comprise at least some of the plurality of conduits;

wherein the first heat transfer chamber positioned above the second heat transfer chamber receives the heated gas from the combustion chamber prior to the second heat transfer chamber and wherein heated fluid is discharged from the heated fluid outlet of the upper drum.

2. The boiler as recited in claim 1, wherein the first heat transfer chamber and the second heat chamber comprise horizontal chambers.

3. The boiler as recited in claim 1, wherein the at least some of the plurality of conduits that comprise the walls of the combustion chamber, first heat transfer chamber, and second heat transfer chamber are substantially in contact with each other wherein passage of gas between the conduits is substantially prevented.

4. The boiler as recited in claim 1, further comprising at least one third heat transfer chamber positioned below the second heat transfer chamber, the third heat transfer chamber having an inlet adapted to receive heated gas from the outlet of the second heat transfer chamber and a outlet, wherein walls of the third heat transfer chamber comprise at least some of the plurality of conduits.

5. The boiler as recited in claim 1, wherein at least some of the plurality of conduits traverse at least one of the first heat transfer chamber and the second heat transfer chamber.

6. The boiler as recited in claim 1, wherein the heated gas discharged from the outlet of the combustion chamber comprises a first temperature and the heated gas discharged from the outlet of the first heat transfer chamber comprises a second temperature, lower than the first temperature.

7. The boiler as recited in claim 1, wherein the boiler comprises a thermal efficiency of at least about 80 percent.

8. The boiler as recited in claim 1, further comprising a housing enclosing the boiler, wherein the housing comprises a plurality of removablely mounted panels.

9. The boiler as recited in claim 8, wherein the plurality of removablely mounted panels is thermally insulated.

10. The boiler as recited in claim 1, wherein at least some of the plurality of conduits is ferrule-mounted to at least one of the lower drum and the upper drum.

11. The boiler as recited in claim 1, wherein the at least one downcomer is adapted to permit convection flow of fluid from the upper drum to the lower drum.

12. The boiler as recited in claim 1, wherein the fluid in the conduits comprising the walls of the first heat transfer chamber comprises a temperature greater than the temperature of the fluid in the walls of the second heat transfer chamber.

13. A method for producing steam in a boiler comprising:

a lower drum adapted to receive a fluid;

an upper drum having a heated fluid outlet;

a plurality of conduits adapted to transfer fluid from the lower drum to the upper drum;

a combustion chamber having walls comprising at least some of the plurality of conduits;

a first heat transfer chamber having walls comprising at least some of the plurality of conduits; and a second heat transfer chamber positioned below the first heat transfer chamber, the second heat transfer chamber having walls comprising at least some of the plurality of conduits;

the method comprising:

introducing a heated gas stream to the combustion chamber and heating the fluid in the conduits that comprise the walls of the combustion chamber;

passing the heated gas stream from the combustion chamber to the first heat transfer chamber and heating the fluid in the conduits that comprise the walls of the first heat transfer chamber;

passing the heated gas stream from the first heat transfer chamber to the second heat transfer chamber, below the first heat transfer chamber, and heating the fluid in the conduits that comprise the walls of the second heat transfer chamber;

discharging the heated gas from the second heat transfer chamber; and generating heated fluid in at least some of the plurality of conduits that comprise the walls of at least one of the combustion chamber, the first heat transfer chamber, and the second heat transfer chamber.

14. The method as recited in claim 13, wherein the boiler further comprises at least one downcomer, the at least one downcomer adapted to transfer fluid from the upper drum to the lower drum, wherein the method further comprises passing fluid from the upper drum to the lower drum.

15. The method as recited in claim 13, further comprising passing the heated fluid in the plurality of conduits to the upper drum, and discharging the heated fluid from the heated fluid outlet of the upper drum.

16. The method as recited in claim 13, wherein passing the heated gas stream from the first heat transfer chamber to the second heat transfer chamber is practiced in a downward direction.

17. The method as recited in claim 13, wherein the boiler further comprises at least a third heat transfer chamber having walls comprising at least some of the plurality of conduits, and the method further comprises passing the heated gas stream from the second heat transfer chamber to at least the third heat transfer chamber and heating the fluid in the conduits that comprise the walls of the third heat transfer chamber.

18. The method as recited in claim 17, wherein passing the heated gas stream from the second heat transfer chamber to at least the third heat transfer chamber comprises passing the heated gas in a downward direction.

19. The method as recited in claim 13, wherein the fluid in the plurality of conduits comprises one of water, steam, and combinations thereof.

20. The method as recited in claim 13, wherein the method is practiced wherein an average temperature of the fluid in the conduits comprising the walls of the first heat transfer chamber is greater than an average temperature of the fluid in the conduits comprising the walls of the second heat transfer chamber.

* * * * *